US011713100B2

(12) United States Patent
Shinn et al.

(10) Patent No.: US 11,713,100 B2
(45) **Date of Patent: *Aug. 1, 2023**

(54) ROTATABLE HULL AND MULTIDIRECTIONAL VESSEL

(71) Applicant: Argo Rocket Marine, Inc., San Diego, CA (US)

(72) Inventors: George Parker Shinn, San Diego, CA (US); Pete Melvin, Huntington Beach, CA (US)

(73) Assignee: Argo Rocket Marine, Inc., S', CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/559,030

(22) Filed: Dec. 22, 2021

(65) Prior Publication Data

US 2022/0106024 A1 Apr. 7, 2022

Related U.S. Application Data

(63) Continuation of application No. 16/554,472, filed on Aug. 28, 2019, now Pat. No. 11,286,023.

(Continued)

(51) Int. Cl.
*B63B 35/52* (2006.01)
*B63B 1/10* (2006.01)

(Continued)

(52) U.S. Cl.
CPC ..... *B63B 35/52* (2013.01); *B63B 1/10* (2013.01); *B63B 1/20* (2013.01); *B63B 3/14* (2013.01)

(58) Field of Classification Search
CPC ..... B63B 35/00; B63B 35/52; B63B 1/00; B63B 1/10; B63B 1/20; B63B 3/00; B63B 3/14

(Continued)

(56) References Cited

U.S. PATENT DOCUMENTS 1,422,542 A 7/1922 Creed
1,753,399 A 4/1930 Blair (Continued)

FOREIGN PATENT DOCUMENTS

WO 03093097 A2 11/2003

OTHER PUBLICATIONS

International Search Report of PCT/US2019/048661, dated Oct. 29, 2019.

*Primary Examiner* — Lars A Olson
(74) *Attorney, Agent, or Firm* — Procopio Cory Hargreaves and Savitch LLP

(57) ABSTRACT

A novel rotatable hull that generally includes a hull that is capable of rotating around an attachment point where it is connected to a vessel. In preferred embodiments, an outdoor motor mounted to the rotatable hull will turn to vector thrust and apply a moment to rotate the hull around a nominally vertical axis where the hull connects to the vessel. The invention also is directed to a vessel, which employs a plurality of rotatable hulls. A plurality of rotatable hulls can be arranged into a tripod, square or other stable geometric configuration and connected by a structure to form a vessel that can move in any direction along the plane of the surface of the water with or without changing the yaw axis orientation of the connecting structure. This may be useful in applications such as catching objects that are descending from the sky.

20 Claims, 7 Drawing Sheets

Related U.S. Application Data

(60) Provisional application No. 62/798,477, filed on Jan. 30, 2019, provisional application No. 62/732,482, filed on Sep. 17, 2018, provisional application No. 62/723,647, filed on Aug. 28, 2018.

(51) Int. Cl.
*B63B 1/20* (2006.01)
*B63B 3/14* (2006.01)

(58) Field of Classification Search
USPC ..... 114/261
See application file for complete search history.

(56) References Cited

U.S. PATENT DOCUMENTS

| | | | | |
|---|---|---|---|---|
| 1,815,286 | A | 7/1931 | Blair | |
| 2,804,038 | A | 8/1957 | Barkla | |
| RE33,359 | E | 10/1990 | Lang | |
| 6,789,490 | B2 | 9/2004 | Schmidt | |
| 7,950,020 | B2 | 5/2011 | Sun et al. | |
| 11,286,023 | B2 * | 3/2022 | Shinn | B63B 1/10 |
| 2003/0154896 | A1 | 8/2003 | Schmidt | |
| 2007/0062428 | A1 * | 3/2007 | Eveleth | B63B 1/125 114/39.31 |
| 2011/0297070 | A1 | 12/2011 | Riggs et al. | |

* cited by examiner

FIG. 3
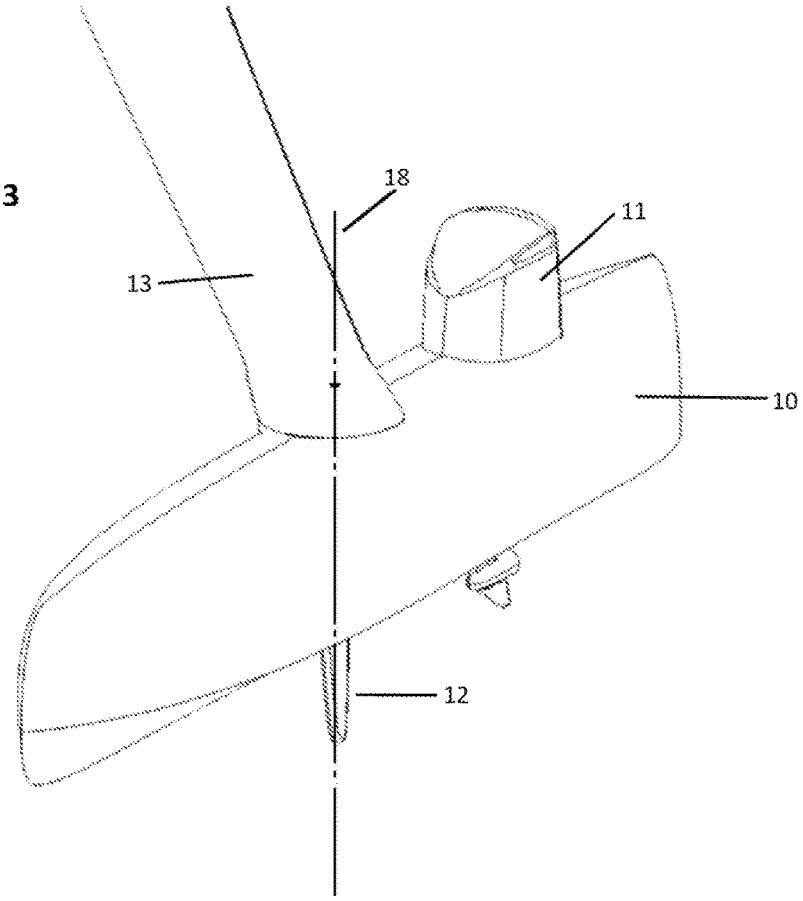
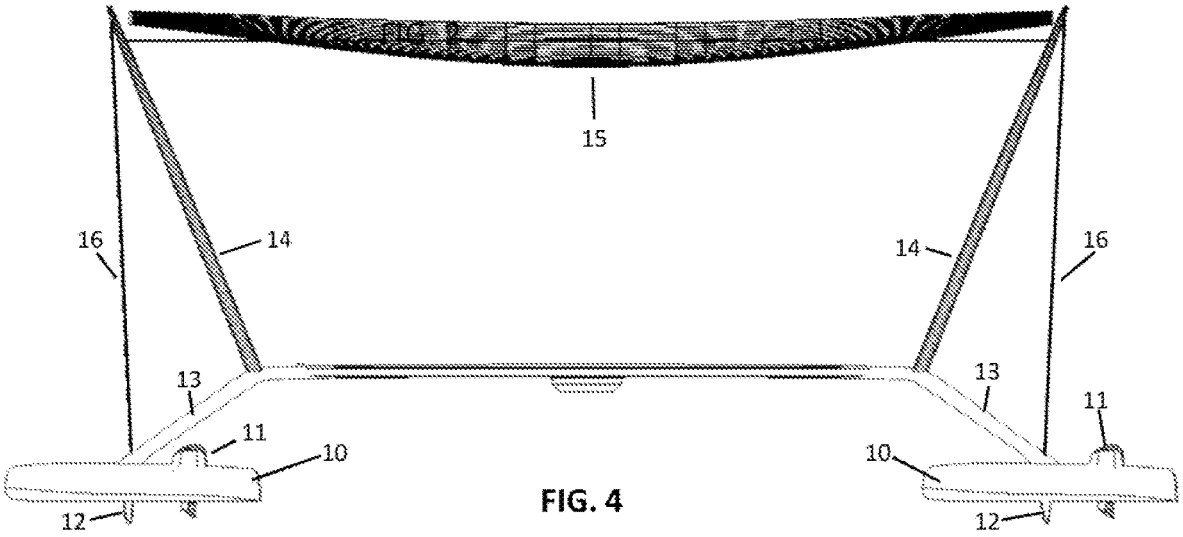
FIG. 4

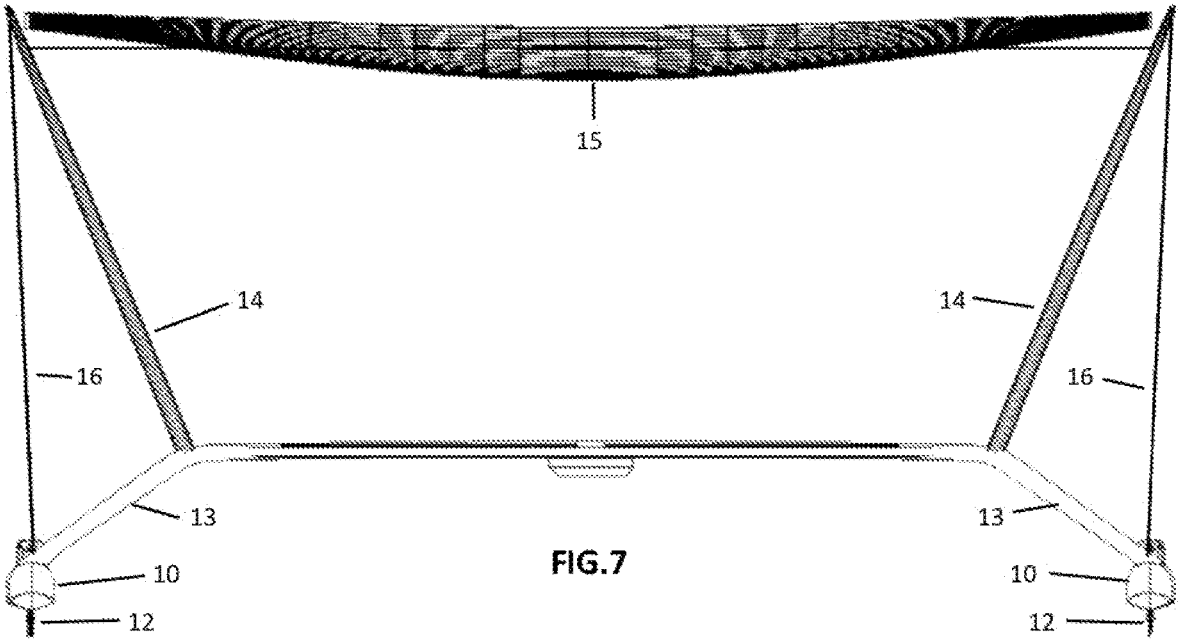
FIG.7
FIG.8
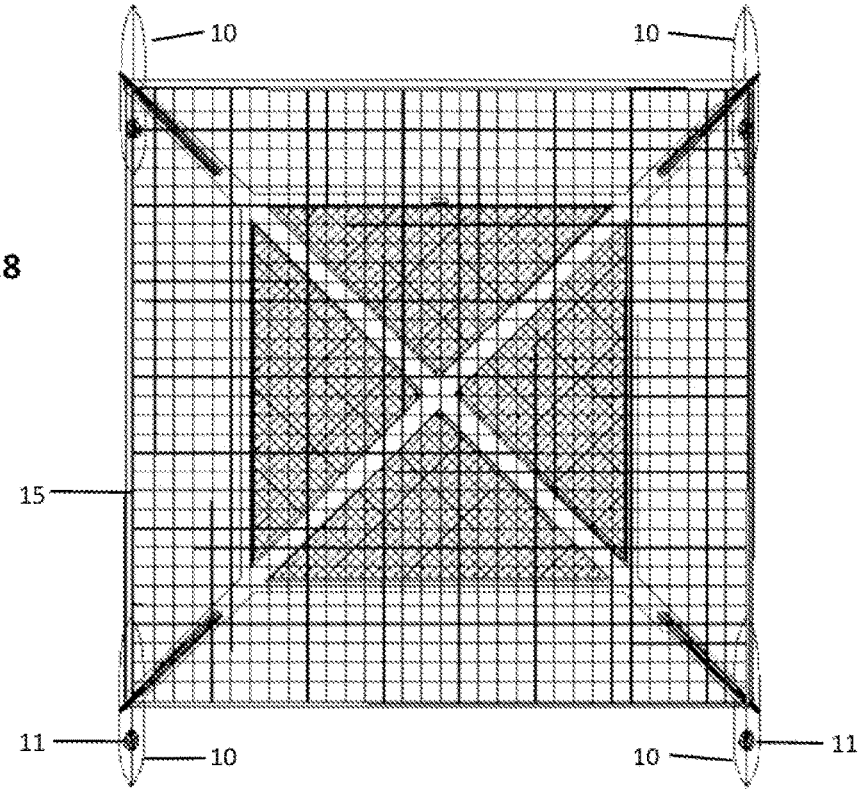

ROTATABLE HULL AND MULTIDIRECTIONAL VESSEL

CROSS-REFERENCE TO RELATED APPLICATIONS

This application is a continuation of U.S. patent application Ser. No. 16/554,472, filed Aug. 28, 2019, which claims priority to U.S. Patent Application No. 62/723,647, filed Aug. 28, 2018; U.S. Patent Application No. 62/798,477, filed Jan. 30, 2019; and U.S. Patent Application No. 62/732,482, filed Sep. 17, 2019. The entire contents of the above applications are incorporated herein by reference in their entirety.

BACKGROUND OF THE EMBODIMENTS OF THE INVENTION

Rocket reusability is becoming an important aspect of space company's efforts to reduce launch cost. SpaceX has used a ship with a large net built on the back to catch their rocket fairings as they descend toward the ocean, United Launch Alliance is planning to catch and recover rocket engines, and Rocket Lab has announced that they will catch and reuse their boosters. It is important that these components do not come in contact with the ocean, as this would damage them and increase refurbishment cost. Rocket components often descend via a parachute making it very difficult to predict the exact location where they will land as well as making it difficult to catch them. To improve the likelihood of making a successful catch, a vessel is needed that is highly maneuverable and capable of quick lateral accelerations. This will make it much easier to position the vessel directly underneath the rocket component as it lands.

BRIEF SUMMARY OF THE EMBODIMENTS OF THE PRESENT INVENTION

The embodiments of the present invention include a novel rotatable hull 10 that is capable of rotating around a nominally vertical axis at an attachment point where it is connected to a vessel. The rotatable hull preferably includes a propulsion system and appendage 12. A plurality of rotatable hulls can be arranged in a triangular, square or any other stable geometric configuration, and attached together using cross beams or some other structure to form a vessel. Each hull is capable of rotating independently. Vectoring thrust from a motor, which may be either inboard or outboard, may be used to rotate a hull. Other embodiments may use a rudder, ring gear or hydraulic ram to rotate a hull about its nominally vertical axis. Hydrofoils may also be attached to a hull to provide lift, to improve maneuverability, or to improve performance in waves.

Other embodiments of a rotatable hull may comprise hull shapes designed to operate beneath the surface of the water. A subsurface rotatable hull 30 (shown in FIGS. 12 and 13) may be attached to a vessel or structure by a nominally vertical strut 20. A vertical strut 20 may support one or more hulls that can be designed to operate either on or below the surface of the water. A plurality of hulls may be used to control flotation height by providing varying amounts of displacement at different altitudes.

Some embodiments may comprise a hydrofoil 21 (shown in FIG. 9) that has a vertical lift component and is attached to the hull or nominally vertical strut 20. Hydrofoils have the ability to reduce drag, increase top speed, provide better fuel efficiency and improve seakeeping. Some embodiments may also comprise a system to control hydrofoil pitch.

The embodiments of the present invention also comprise the design of a vessel, which employs a plurality of rotatable hulls connected by beams. This vessel may be designed in a variety of configurations such as a triangle or tripod, square, X, catamaran, trimaran or other embodiment and comprise one or more propulsion systems, which may be mounted to the rotatable hulls or elsewhere. A vessel, by rotating the hulls, can perform turns in a sway motion without changing the yaw axis orientation of the connecting structure. This vessel may comprise a support structure for a net or other device for catching objects. Detachable beams may be used to make the vessel easy to disassemble for transportation or storage.

BRIEF DESCRIPTION OF THE DRAWINGS

FIG. 3 shows a diagonal overview of an embodiment of the rotatable hull.

FIG. 4 illustrates a side view of an embodiment of the vessel.

FIG. 7 shows a front view of an embodiment of the vessel.

FIG. 8 shows a top view of an embodiment of the vessel.

DETAILED DESCRIPTION OF THE EMBODIMENTS OF THE INVENTION

New rotatable hulls and a vessel, which employ a plurality of these hulls, are discussed herein. In the following description, for purposes of explanation, numerous specific details are set forth in order to provide a thorough understanding of the embodiments of the present invention. It will be evident, however, to one skilled in the art that the embodiments of the present invention may be practiced without certain specific details.

The embodiments of the present invention as described herein are to be considered an exemplification of the invention and are not intended to limit the invention to the specific embodiments illustrated by the figures or description below. The embodiments of the present invention will now be described by referencing the appended figures representing preferred embodiments.

Figure 2:
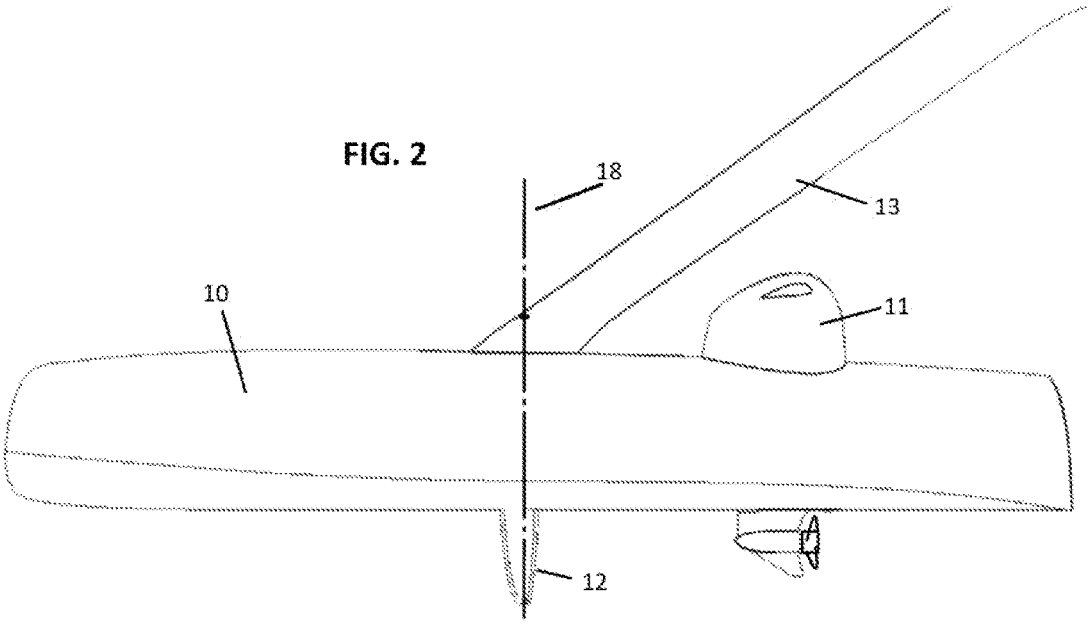
FIG. 2 shows a side view of an embodiment of the rotatable hull.
Figure 5:
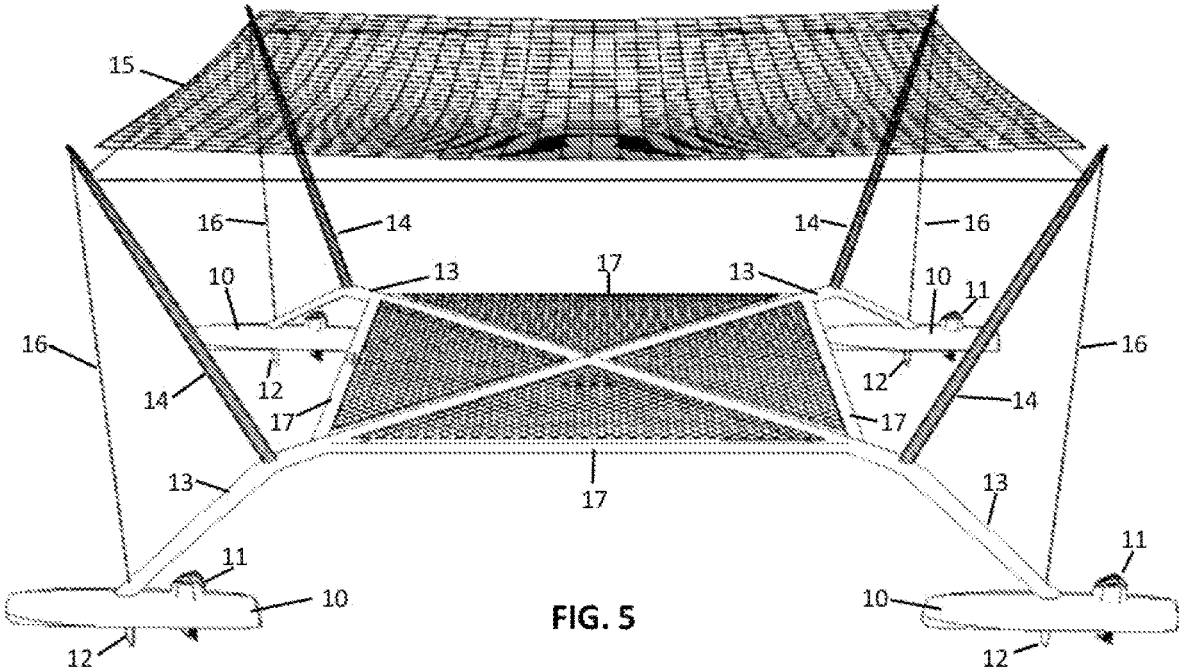
FIG. 5 illustrates a side overview of an embodiment of the vessel.
Figure 6:
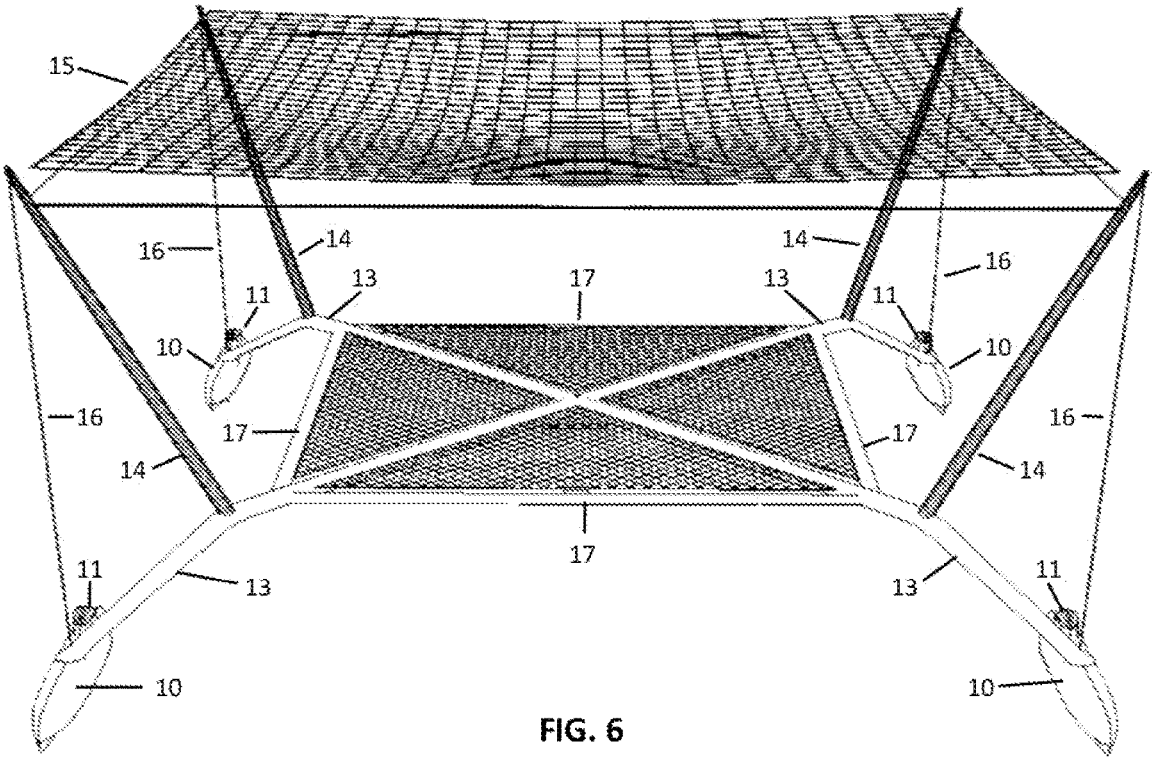
FIG. 6 illustrates a front overview of an embodiment of the vessel.

FIG. 2 depicts an example of a rotatable hull 10 according to various embodiments of the present invention. In preferred embodiments, the rotatable hull 10 is of a planing design with a wave piercing bow, an outboard motor 11, a control system for the motor and an appendage 12. The hull 10 includes an attachment point that connects to a vessel and allows the hull to rotate around an axis 18 that is generally perpendicular to the surface of the water, where the axis preferably traverses the attachment point and center of the appendage 12. In preferred embodiments, a propulsion system includes an outboard motor 11 that can turn to vector thrust and apply a moment to rotate the hull 10A. The outboard motor 11 is shown on the top, back of the hull but it can be disposed on other sections of the hull as understood by a person of ordinary skill in the art. In other embodiments, motors may be either electric or combustion and may be either inboard or outboard. Other embodiments may use a rudder, ring gear or hydraulic ram to rotate the hull 10A. Preferably the hull 10 would have a pulled in stern in the shape of a bow to allow high reverse speeds. The appendage 12 generally includes a vertical orientation underneath the hull 10 in the shape of an airfoil such that it produces minimal drag and provides lateral resistance for steering. A rotatable hull 10A does not have to have this appendage underneath it, but will generally not turn as sharply without one. The hull 10A, appendage 12 and any other elements may be made from wood, composite, metal, foam, honeycomb, or any material used in vessel building. A shock absorption system (not shown) may be incorporated where the hull attaches to the vessel beam. This may provide the hull with freedom of movement vertically, horizontally, in pitch and in roll. In preferred embodiments, a rotatable hull 10 may be rotated independently or in conjunction with other rotatable hulls. In preferred embodiments, rotatable hulls 10 would be able to rotate through 360 degrees. Other embodiments may limit the degrees of rotation.

Figure 13:
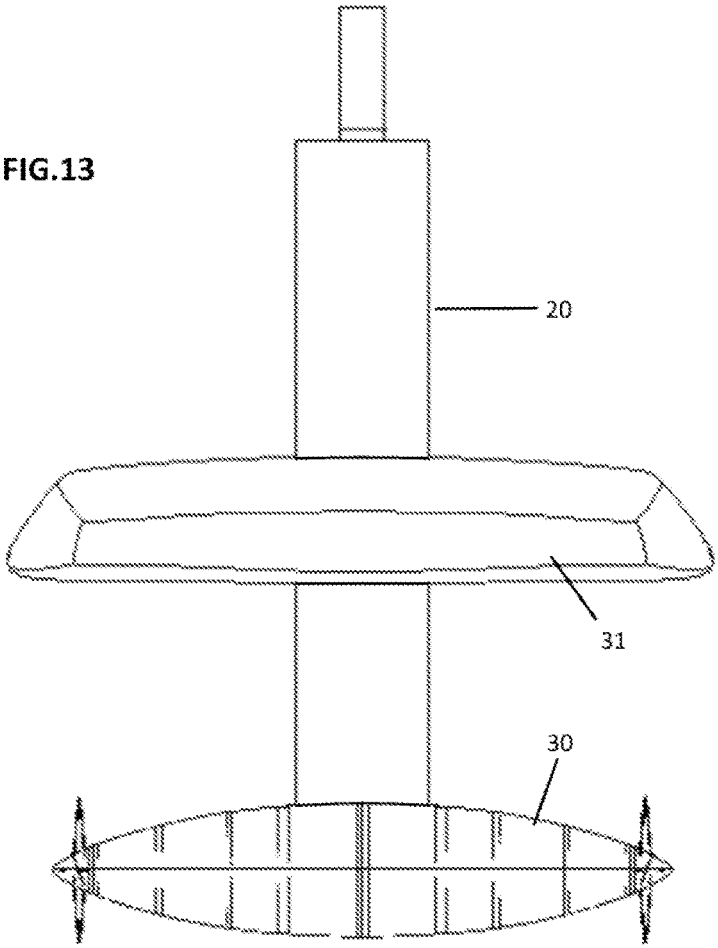
FIG. 13 shows a subsurface rotatable hull and a height controller mounted to a strut.

FIG. 13 depicts an alternative embodiment of a rotatable hull that includes a plurality of hulls mounted to a nominally vertical strut 20 to provide displacement including a subsurface bulb 30 designed to operate below the surface as well as a second hull designed to operate on the surface as a height controller 31. The height controller 31 may include a wave piercing design. The strut 20 includes the shape of an airfoil such that it produces minimal drag and assists with steering. The strut 20, height controller 31, and subsurface bulb 30 elements may be made from wood, composite, metal, foam, honeycomb, or any material used in boatbuilding. Other embodiments may include several hulls at varying heights. The shape of the strut 20 could also be enlarged so that it provides a more substantial amount of displacement. The rotatable subsurface hull 30, height controller 31, and strut 20 are mounted to the vessel in a way such that they can be rotated for steering.

Figure 9:
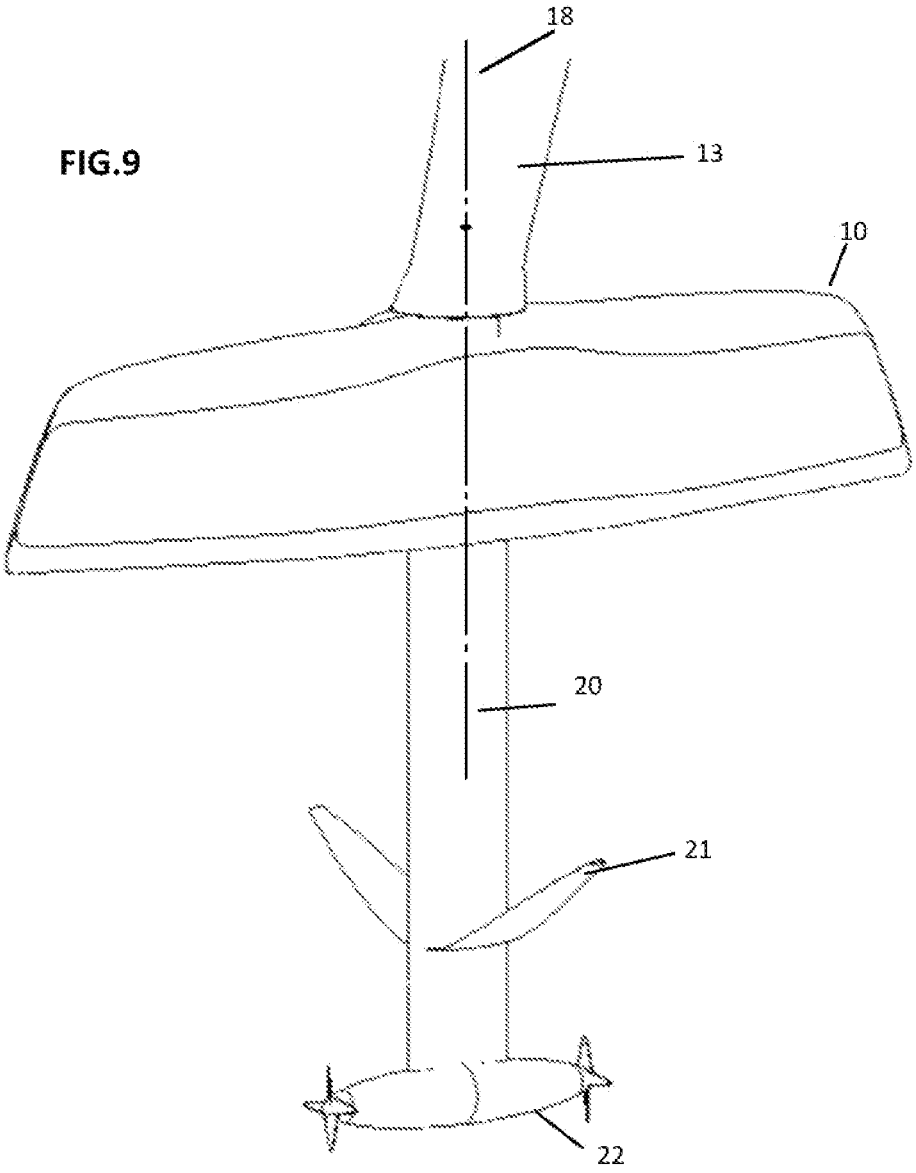
FIG. 9 shows a diagonal overview of an embodiment of the rotatable hull with a hydrofoil configuration.
Figure 10:
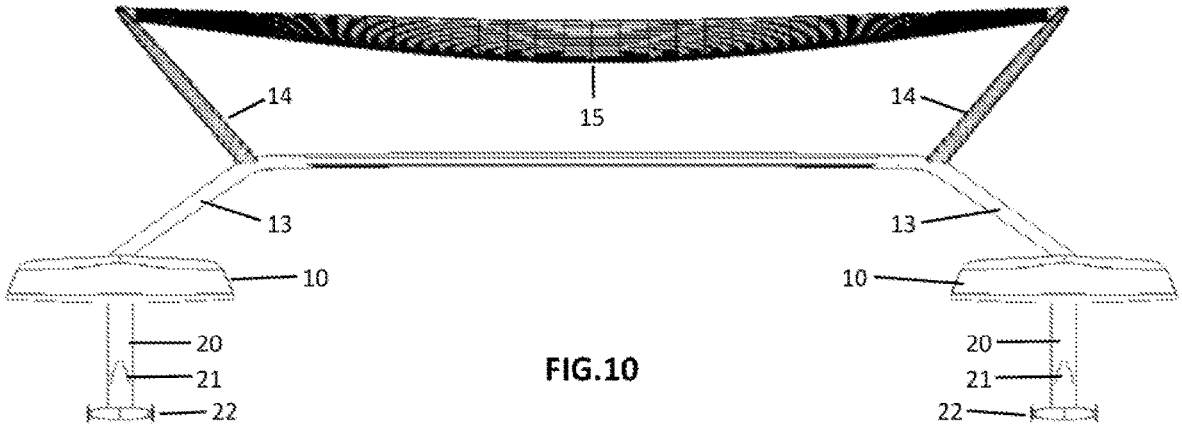
FIG. 10 shows a side view of an embodiment of the vessel with a hydrofoil configuration.
Figure 11:
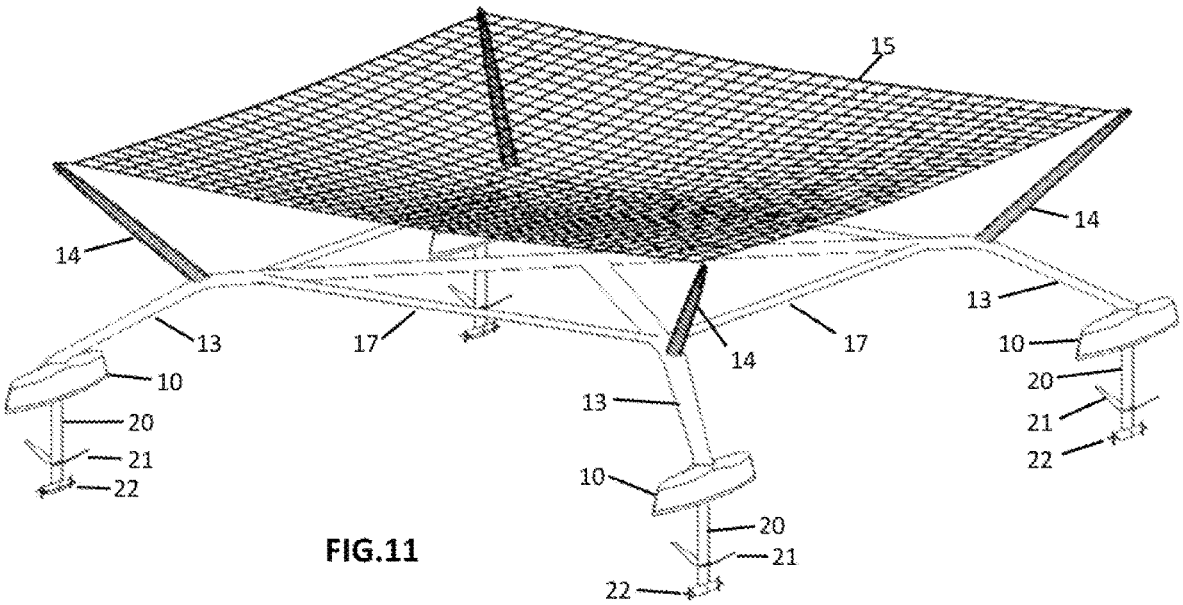
FIG. 11 shows a diagonal overview of an embodiment of the vessel with a hydrofoil configuration.

FIG. 9 depicts an alternative embodiment of a rotatable hull device that includes a hull 10, nominally vertically mounted strut 20, hydrofoil 21, and a propulsion system 22 attached to the bottom of the strut. The vertical strut 20 is in the shape of an airfoil such that it produces minimal drag and assists with steering. The hydrofoil 21 may be either horizontal having a wing design as shown in FIG. 9 or diagonal, and are provided to adjust the angle of attack. The propulsion system 22 includes an electric motor, gearbox and driveshaft housed within a bulb at or near the bottom of the vertical strut 20A. In other embodiments, a propulsion system includes an outboard motor that can turn to vector thrust and apply a moment to rotate the hull. Other embodiments may use a rudder, ring gear or hydraulic ram to rotate the hull.

Figure 1:
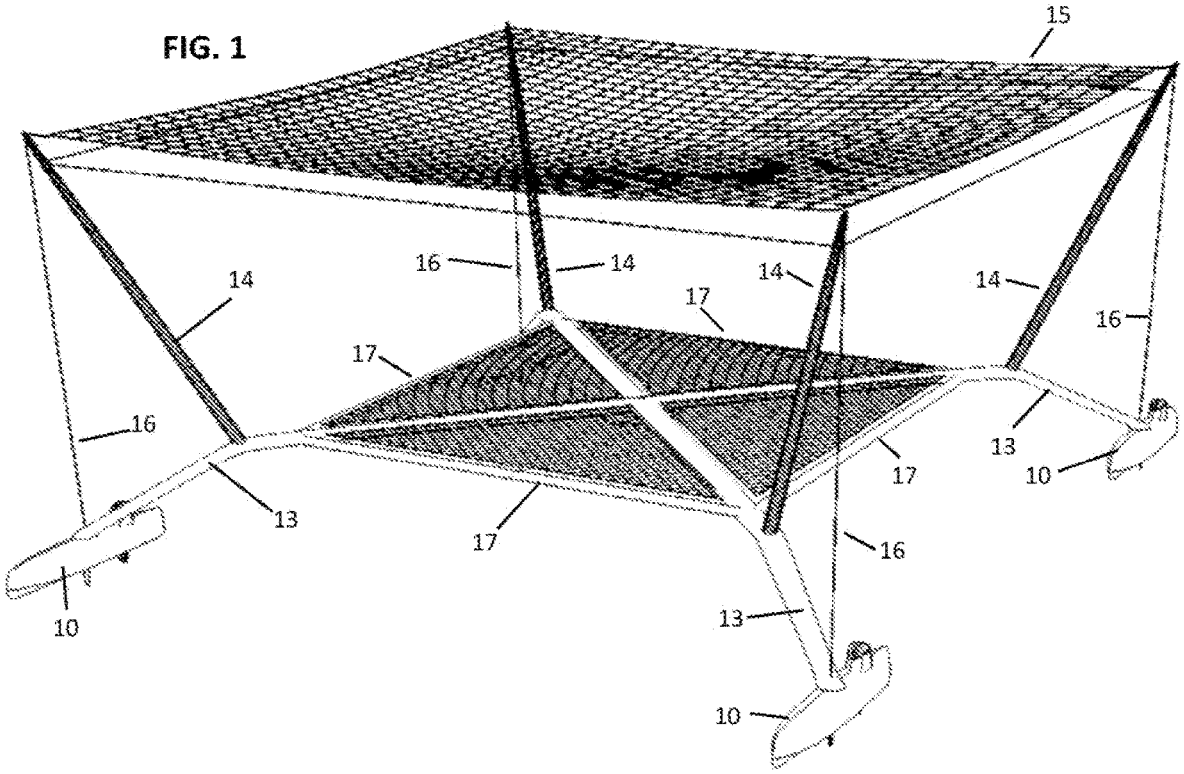
FIG. 1 shows a diagonal overview of an embodiment of the vessel.
Figure 12:
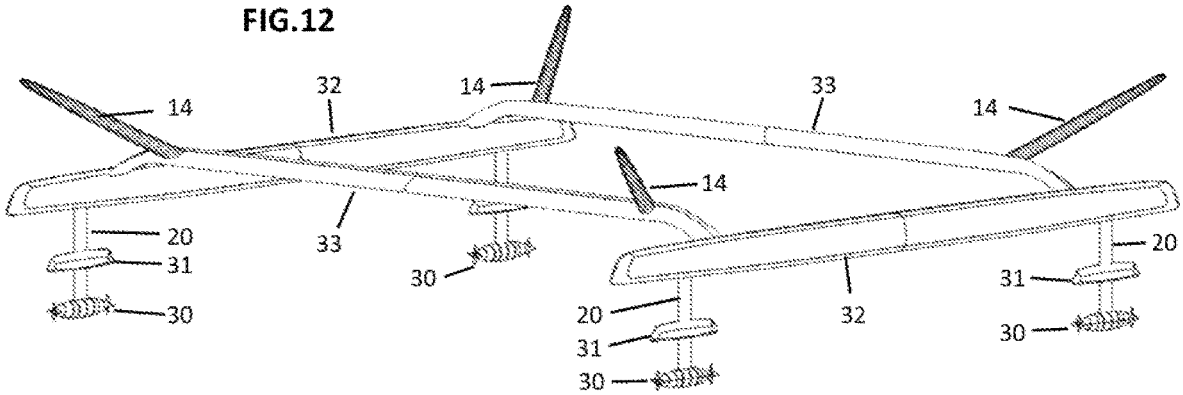
FIG. 12 shows a diagonal overview of an embodiment of the vessel in a catamaran configuration with subsurface rotatable hulls (not showing the net).

FIG. 1 and FIG. 4-8 depict various views of a preferred embodiment of a vessel employing a plurality of rotatable hulls. The vessel includes four intersecting crossbeams 13, four horizontal struts, four tension cables 17 connecting the crossbeams 13, four net supports 14 (each disposed at or near each corner), and four rotatable hulls 10. In preferred embodiments, crossbeams 13 are arranged in an X design as shown in FIG. 1, but they can also be arranged as a square as shown in FIG. 12. Struts or tension cables 17 are used to provide stiffness by connecting crossbeams 13 to form a triangle as shown in FIG. 1. The net supports 14 are used to hold a net 15 above the vessel to catch a descending object such as the rocket components described in the background of the invention as provided above. Shrouds 16 are used to hold the net supports 14 and tension the net 15, and preferably traverse the top of net support 14 and top of the crossbeam 13 as shown in FIG. 1. The vessel could also take the form of many other embodiments such as three rotatable hulls 10 arranged in a triangle or a plurality of rotatable hulls 10 arranged in any other stable geometric configuration. Connecting three crossbeams 13 in the center like a tripod may be used to form a triangle configuration. There could be other devices used to catch the rocket parts such as an inflatable bag attached to the upper side of the crossbeams 13. The vessel may be constructed from wood, composite, metal, foam, honeycomb, or any material used in boatbuilding. The benefit of utilizing a plurality of small rotatable hulls 10A to provide buoyancy for a vessel rather than a single large hull is that smaller hulls have a smaller turning radius. This allows the vessel to make rapid lateral accelerations so that it can accurately position itself to catch a descending object.

FIG. 12 depicts an alternative embodiment of a vessel employing a plurality of rotatable hull devices. The vessel is of a catamaran design and includes two main hulls 32, two cross beams 33, four net supports 14, and four subsurface rotatable hulls 30, each disposed at or near each corner. In preferred embodiments, the two main hulls 32 provide sufficient buoyancy to keep the vessel afloat once an object has been caught by the vessel. The two cross beams 33 are preferably disposed near the ends of the two main hulls 32, but not so close that they are susceptible to impacts from waves. Other embodiments may include additional beams. The cross beams 33 could also be designed to fold or collapse in such a way that the vessel becomes narrower for transportation or storage.

The vessel may be driven either by a pilot, or by a software guidance system. A software guidance system may use data including but not limited to inertial navigation systems, GPS, barometric altimeter, radar altimeter, radar, weather balloons, weather satellites, video camera, data being transmitted from the object to be recovered or other relevant information to calculate and update the projected position, velocity, and course of the descending object. The guidance system would position the vessel to intercept the descending object so that it may be caught by the vessel.

The vessel may include a tent made of a protective material such as molded composite, ultra high molecular weight polyethylene fiber, pvc coated canvas or other suitable material to keep water or other contaminating substances from contacting the rocket component.

To prevent the net from long exposures to potentially contaminating substances, the vessel may include a system to rapidly deploy the net shortly before catching the object. In preferred embodiments, this includes a protective bag supported in the center of the vessel to store the net and powered winches to hoist the net into position.

To prevent a descending object from impacting a net support 14, pads may be used as a fender. In preferred embodiments, these may be pneumatic, foam or some other material capable of absorbing impact.

The embodiments of the present invention include a vessel shown in FIGS. 1 and 4-8. The vessel, when assembled, includes a plurality of cross beams 13 including longitudinal structures that form an X shape when disposed horizontally as shown at least in FIG. 1. A tension cable or strut 17 is connected to at least two cross beams to form a triangular shape as shown in FIG. 1. A plurality of net supports 14 including a member having two ends, a first end connected to a cross beam as preferably shown in FIG. 1 and a second end with an attachment mechanism for attaching a net 15 thereto. The net supports 14 are preferably disposed vertically and outwardly from a center point of the X shape of the plurality of cross beams 13 to create tension on the net 15 when disposed where the angular relationship of the vertical disposition of the net supports is in the range of 15-60 degrees from a vertical Y axis. A hull 10 connected to a distal end of a cross beam as shown in FIG. 1 includes a motor 11 for propulsion and a control system, where the control system allows the hull 10 to be rotated around an axis from zero to 360 degrees, where the axis is generally perpendicular to the surface of the water. The vessel may include a shroud 16 connected to the second end of the net support and the distal end of the cross beam 13 as shown in FIG. 1. The cross beam 13 as shown in FIGS. 1 and 4-7, and best shown in FIG. 4, includes two sections, a first section "F" on a horizontal plane and a second section "S" angularly disposed to the first section, the angle "A" being in the range of 10-75 degrees from the horizontal plane, and preferably a 30-60 degree range. As shown in FIG. 1, the first end of the net support member is connected to a cross beam 13 as preferably shown in FIG. 1, namely on a top side of the cross beam 13, at or around the angle "A" of the cross beam 13 as best shown in FIG. 4. The plurality of hulls 10 (3 shown in FIG. 1; 4 shown in FIG. 6) operate independent from one another or in unison. The hull includes an appendage 12 shown on a lower end of the hull as shown in FIG. 2 to provide lateral resistance for steering. The hull includes a planing design with a wave piercing bow, a displacement hull design, and a bulb design. The motor includes an inboard or outboard motor (as shown in FIG. 2) for propulsion. The vessel is driven by a pilot or a software guidance system as described above.

We claim:

1. A vessel, comprising:

a net structure to catch descending objects;

a plurality of hulls, each hull including an attachment that connects to the vessel and allows the hull to rotate around an axis that is generally perpendicular to a surface of the water;

a propulsion system associated with each hull;

wherein the net structure spans an area above and between the plurality of hulls.

2. The vessel according to claim 1, wherein the plurality of hulls have one of a planing, displacement hull design and a subsurface bulb hull design.

3. The vessel according to claim 1, wherein each propulsion system is capable of thrust vectoring.

4. The vessel according to claim 1, wherein the plurality of hulls each include a ring gear mounted around the rotation axis.

5. The vessel according to claim 1, wherein the plurality of hulls are configured in any geometric shape.

6. The vessel according to claim 1, further including a guidance system configured to position the vessel underneath a descending object.

7. The vessel according to claim 1, further including a tent to cover a caught object in a protective material.

8. A multi-hull vessel for catching a descending rocket component or object descended by parachute, comprising:

a net structure to catch the descending rocket component or object descended by parachute;

a plurality of hulls, each hull including an attachment that connects to the vessel and allows the hull to rotate around an axis that is generally perpendicular to a surface of the water;

a propulsion system associated with each hull.

9. The vessel according to claim 8, wherein the plurality of hulls have one of a planing, displacement hull design and a subsurface bulb hull design.

10. The vessel according to claim 8, wherein each propulsion system is capable of thrust vectoring.

11. The vessel according to claim 8, wherein the plurality of hulls each include a ring gear mounted around the rotation axis.

12. The vessel according to claim 8, wherein the plurality of hulls are configured in any geometric shape.

13. The vessel according to claim 8, further including a guidance system configured to position the vessel underneath a descending object.

14. The vessel according to claim 8, further including a tent to cover a caught object in a protective material.

15. A multi-hull vessel for catching a descending rocket component or object descended by parachute, comprising:

an airbag that spans an area above and between the plurality of hulls to catch the descending rocket component or object descended by parachute;

a plurality of hulls, each hull including an attachment that connects to the vessel and allows the hull to rotate around an axis that is generally perpendicular to a surface of the water;

a propulsion system associated with each hull.

16. The vessel according to claim 15, wherein the plurality of hulls have one of a planing, displacement hull design and a subsurface bulb hull design.

17. The vessel according to claim 15, wherein each propulsion system is capable of thrust vectoring.

18. The vessel according to claim 15, wherein the plurality of hulls each include a ring gear mounted around the rotation axis.

19. The vessel according to claim 15, wherein the plurality of hulls are configured in any geometric shape.

20. The vessel according to claim 15, further including a guidance system configured to position the vessel underneath a descending object.

* * * * *